United States Patent [19]

Seletyn

[11] 4,106,178

[45] Aug. 15, 1978

[54] THREADED STUD DRIVING TOOL

[76] Inventor: James P. Seletyn, P.O. Box 207, Scarbro, W. Va. 25917

[21] Appl. No.: 749,382

[22] Filed: Dec. 10, 1976

[51] Int. Cl.[2] ..... B25B 13/50

[52] U.S. Cl. ..... 29/428; 81/53.2

[58] Field of Search ..... 81/53.2; 403/16, 112, 403/343; 29/229, 428, 446, 526

[56] References Cited

U.S. PATENT DOCUMENTS

| | | | |
|---|---|---|---|
| 2,521,910 | 9/1950 | Goldberg | 81/53.2 |

FOREIGN PATENT DOCUMENTS

| | | | |
|---|---|---|---|
| 662,474 | 7/1938 | Fed. Rep. of Germany | 81/53.2 |
| 1,045,927 | 12/1958 | Fed. Rep. of Germany | 81/53.2 |
| 219,912 | 8/1924 | United Kingdom | 81/53.2 |

*Primary Examiner*—James L. Jones, Jr.

*Attorney, Agent, or Firm*—Cushman, Darby & Cushman

[57] ABSTRACT

A stud driving tool for use with wrenches or powered equipment for driving threaded studs into threaded holes and for preventing back rotation of such studs during removal of the driving tool from driven studs. The driving tool is provided with a slightly oversized threaded internal bore for receiving the threaded stud on one end and connection means for connecting the tool to wrenches or powered equipment on the other end. A flexible member is provided within the threaded internal bore which serves as a stop member to prevent the stud from bottoming out within the tool's threaded bore. The flexible member is a rolled pin which is slightly resilient or springy but allows sufficient torque to be exerted on the stud to assure it is tightly driven into the threaded hole and also allows the gripped end of the stud to be easily released.

11 Claims, 6 Drawing Figures

THREADED STUD DRIVING TOOL

BACKGROUND OF THE INVENTION

The present invention relates to an improved stud driver or coupling member for inserting or driving threaded studs into structures containing threaded holes. This most usually is required for holding members together such as holding various covers on an automobile crankcase, holding flanged couplings together or otherwise in general industrial maintenance work or any other assembly operation that would require the use of threaded headless studs. It is well-known that when such headless studs are installed, it is necessary that the installation occur with a considerable amount of torque so that the studs will be tightly secured in place. Therefore, in order to apply the torque essential to drive each stud, it is necessary that the stud be firmly gripped and preferably in a manner that does not damage the stud threads especially at the end of the stud which is to be exposed from the structure since to destroy such threads could render the stud useless. On the other hand, it is essential that the tool used to drive the stud into the threaded hole must be not so firmly engaged with the stud that it is impossible to remove the tool without back rotating the driven member and thus effecting the degree to which the stud has been secured in the threaded hole.

The present invention provides an extremely inexpensive simple and efficient tool which effectively eliminates the back rotating problem associated with known prior art devices and reduces frictional forces during the period when the tool is being removed from the stud.

Examples of known prior art stud wrenches are shown in the following U.S. Pat. Nos.: Bayes, 2,336,157, Goldberg 2,521,910, Tann et al. 2,933,960, Williams 2,199,721.

The device disclosed in Goldberg makes use of an internally threaded tool which has a removable transversely extending hardened solid pin. The hardened pin serves as a removable abutment for the end of a stud when the device is used to drive the stud into a threaded hole. To remove the device from the stud it is presumed that the hardened pin is removed so that the grip on the stud is thereby released. The stud driver disclosed in Bayes employs a horizontally sliding tapered pin or a wedge member which is provided with an inclined surface and a locking plug which is vertically movable. The bottom end of the locking plug directly engages the end stud to be driven while the upper end of the plug engages the inclined surface of the wedge member when the wedge member is moved sideways in a first direction. The locking plug is released when the wedge member is moved in the opposite direction to the first and also thereby releases the driving force exerted on the gripped end of the stud. Williams discloses the use of a driving tool which is provided with a threaded bore for receiving the stud to be driven and a hardened ball bearing at the end of that bore which acts as an abutment against which the exposed end of the stud will strike.

Tann et al. discloses the use of a longitudinally movable anvil which serves to lock together the stud to be driven and the drive member which is threadily engaged with the stud member being driven. The anvil is provided with a circular head which in locking the drive member and the stud together abuts the interior of the tool along a relatively large flat surface relative to the size of the end of the stud. In theory, after the stud has been driven into place the driven member is more easily rotatable within the tool than is the stud within the threaded socket in which it has been driven so that backward rotation of the drive member within the tool releases the engagement between the head of the anvil and the interior of the tool so that the locking relationship between the drive member and the stud is also released.

Problems exist with each of these prior art devices however, primarily in overcoming the effects of deforming the abutment devices and the frictional contact between the drive member and the stud being driven so as to allow easy removal of the tool from the stud without back rotating or removing the stud from its driven position within the threaded bore into which it has been driven. Likewise, additional problems exist in producing tools which can be used for powered rotation either with drills or with impact wrenches. In addition, none of the prior art devices employ a stop member within the driving tool which is in any way resilient in order to minimize the effects of the stop member on the end of the stud being driven.

Therefore, the primary object of the present invention is to provide a stud driving tool which provides sufficient frictional engagement to effectively transfer torque from the tool to the stud being driven so that the stud can be tightly secured in a threaded hole. In addition, it is an object of the present invention to make use of a resilient stop member located within the threaded bore of the tool that will by its springy nature allow for an easy release of the stud and effectively eliminate any back rotation of the stud upon removal of the tool therefrom. In addition, it is an object of the present invention to provide a stud driving tool which has no members protruding therefrom or beyond the exterior surfaces of the tool so that it can be safely used with power equipment.

A still further object of the present invention is to make use of a resilient stop member which can bend in response to the driving torque applied to the stud and to also assist in releasing the end of the stud and thereby effectively eliminating any back rotation. Further, it is an object of the present invention to employ stop member which has a very small amount of surface contact with the end of the threaded stud being driven so that driving torque can be effectively transmitted to the threaded stud but because there is a small amount of resistance at the point of contact and due to the resiliency of the rolled pin, release of the stud is easily effected.

These and other objects will become apparent by referring, for a better understanding of the invention, to the following description taken in conjunction with the accompanying drawings wherein.

Figure 1:
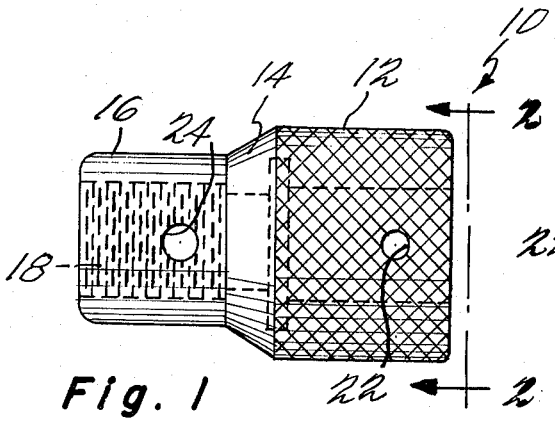
FIG. 1 is a side elevational view of the body portion of the driving tool of the present invention.
Figure 2:
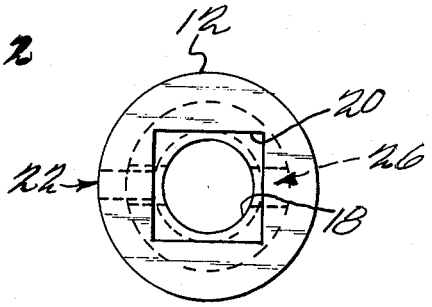
FIG. 2 is an end view of the main portion of the driving tool taken along line 2—2 in FIG. 1.

Referring now to the figures, the main body portion of the stud driving tool according to the present invention is generally indicated at 10 and is comprised of a cylindrical rear portion 12 which can be provided with a knurled exterior surface as shown in FIG. 1. The body of the tool can then be machined down to a smaller outer diameter so as to produce the front portion of the tool and can be beveled at about a 60° angle with respect to the longitudinal axis of the tool as shown at 14 so as to form the cylindrical front portion of the tool 16 which itself is provided with a threaded internal bore as shown at 18. As shown in FIG. 2, the rear portion of the main body of the driving tool is preferably provided with a shaped driving socket in the form of bore 20. While the driving socket 20 is shown as being square for use with conventional English or metric square driving mechanisms, such as ratchets, it should be understood that the driving tool forming the present invention can be used with any type of driving mechanism such as braker bars, speed handles or low torque air or electric impact tools or other conventional types of powered driving equipment. Standard square driving sizes usually vary between ⅜ to 1-inch but it should be understood that the size of driving socket 20 and the particular shape thereof are not critical. Further, the rear portion 12 could also be provided with an exteriorly extending reduced square shank instead of socket 20.

The rear portion 12 of the driving tool 10 is provided with an aperture 22 which extends through the sidewall of the rear portion so as to communicate between the exterior surface thereof and the interior of driving socket 20. This aperture is provided for purposes of employing a locking ball if one is desired to be used.

Figure 3:
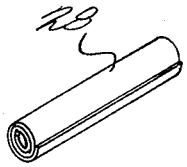
FIG. 3 is a perspective view of the rolled pin used with the present invention.

The front portion 16 of driving tool 10 is provided with a pair of apertures 24 and 26 which respectively extend through opposite sidewall portions of front portion 16. Apertures 24 and 26 are sized so as to receive a rolled pin 28, as shown in FIG. 3. The tool 10 is shown in phantom in FIGS. 4, 5 and 6 in various phases of operations for ease of illustrating the relationship between rolled pin 28 and stud 30. In these figures rolled pin 28 is shown in its installed position within apertures 24 and 26. It should be noted that when so installed, the greatest number of surfaces or wraps of the flat stock contained within rolled pin 28 are directed toward the top surface 32 of the stud 30. This assures that the strongest portion of rolled pin 28 will face and be the portion which directly engages stud 30. This also allows the free ends of the stock material which comprises rolled pin 28 to move when rolled pin 28 engages the top surface 32 of stud 30 and torque is applied thereto.

Figure 4:
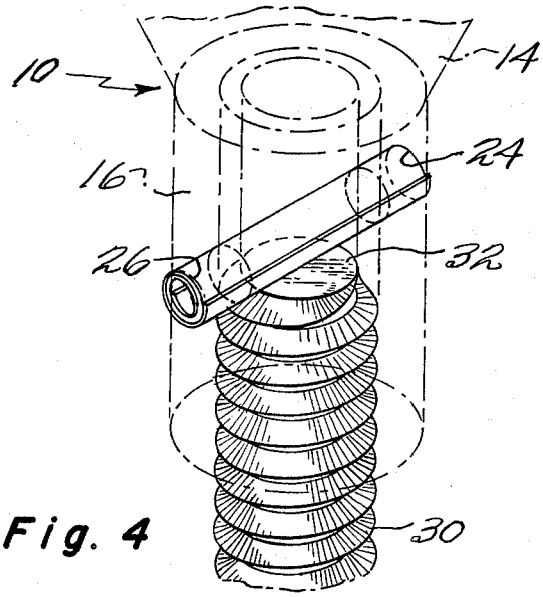
FIG. 4 is a perspective side elevational view where the tool and the rolled pin are in an engaged and driving position with respect to a threaded stud.
Figure 5:
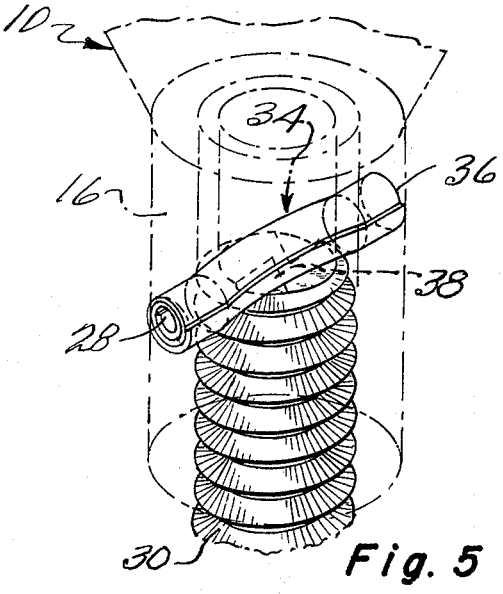
FIG. 5 is a perspective view of the driving tool and the rolled pin and the stud at a later stage of the driving process.
Figure 6:
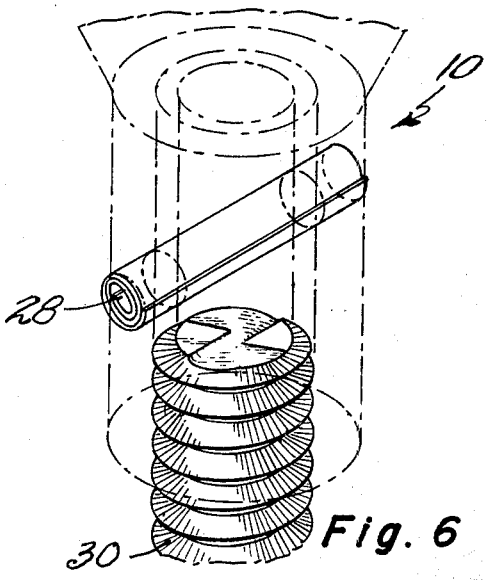
FIG. 6 is a perspective view of the driving tool and the threaded stud following the driving of the stud and the release of driving contact between the rolled pin and the end of the threaded stud.

Referring now to FIGS. 4–6, FIG. 4 shows the relative position of the front portion 16, rolled pin 28 and stud 30 when the driving tool is in a ready-to-drive position. The threaded stud 30 is in threaded engagement with the internal threaded bore 18 of the tool 10 and the top surface 32 of stud 30 is in contact with rolled pin 28. As more torque is applied to the driving tool 10 to force the threaded stud 30 into a threaded bore (not shown) the rolled pin 28 which has a resiliency or springiness to it tends to be curved and takes on a slightly arched shape as shown generally at 34 in FIG. 5. During the early stages of the driving process when rolled pin 28 is being placed under increasing torque conditions, rolled pin 28 tends to slip along two opposing portions of the stud's upper surface 32 thereby forming essentially pie-shaped or wedged areas 36 and 38. Examination of these areas on studs that have been driven following removal of the driving tool show that the deformation within these areas is deeper at the periphery of upper surface 32 than the amount of deformation occurring at the center of surface 32 thereby confirming the resiliency and springy nature of rolled pin 28 and the fact that it tends to bend as shown in FIG. 5. However, the deformation of the top of stud 30 is not so great as to interfere with the threads at the end thereof. Also, the curing of rolled pin 28 reduces the area of contact between the end of stud 30 and rolled pin 28.

As was pointed out previously, and is as shown in FIGS. 4–6, rolled pin 28 is preferably inserted within tool 10 so that the largest number of wraps within pin 28 is directed toward the top of stud 30. By arranging the rolled pin 28 in this manner, the greatest amount of strength of rolled pin 28 will be directed toward the very point of contact with stud 30. In addition, it should be pointed out that the insertion of rolled pin 28 within the tool 10 should be such that rolled pin 28 is installed substantially perpendicularly to the axis of threaded bore 18.

Apertures 24 and 26 were previously indicated as being sized so as to receive rolled pin 28. The fit should be tight such that rolled pin 28 is slightly compressed when inserted into apertures 24 and 26. By inserting rolled pin 28 in this manner, it is possible to replace rolled pins when necessary by simply knocking out the one in place and inserting another.

Also, it is important that the threads within threaded bore 18 be slightly oversized and are preferably about 0.003 to about 0.005 inches larger than normal thread sizes. By making the thread within bore 18 slightly oversized studs 30 will be more easily inserted into tool 10 and likewise retraction away from the rolled pin 28 will be facilitated. It will also be noted that rolled pin 28 is inserted so that the ends thereof will be flush with the outer circumference of front portion 16. By constructing the tool in this fashion, there will be no members protruding from the side thereof or beyond the exterior surfaces of the tool making the tool extremely safe for use with electric drills or other powered rotation equipment such as impact wrenches, etc. It should be kept in mind that the sizes of the threaded bore 18 and the driving socket 20 can vary depending upon the size of studs 30 to be driven and the type of driving tool which is to be employed.

In comparing the present invention employing a rolled-type steel pin with other types of pins, namely a hollow core steel pin and a hardened solid steel pin, it was found that in tests where 150-inch pounds torque was applied two times to the tool in order to insert a stud, a solid hardened pin required a release torque of 65-inch pounds and produced almost a straight line channel across the driven end of the stud. A hollow steel pin required about 40-inch pounds removal torque but have produced extremely large depression areas across the upper surface of the stud and remained in a bent condition following removal of the tool from the end of the stud and could not be used a second time. The rolled pin required a release torque of about 45-inch pounds and produced areas on the driving end of the stud comparable to those shown in the drawings and described hereinbefore. Further, the rolled pin continued to operate in that manner and due to its resiliency and springiness was not permanently bent or deformed as was the hollow core pin.

The driving tool 10 is preferably provided with rounded surfaces so that there are no sharp edges and can be constructed from a medium carbon alloy steel prehardened to a predetermined degree such as indicated on the Rockwell scale C 28-32. One example of such a steel is the Ryerson Rycut-50 heat treated steel manufactured by Ryerson Steel in Cincinnati, Ohio.

It will now be clear that there is provided herein a device which accomplishes the objectives heretofore set forth. While the invention has been disclosed in its preferred form, it is to be understood that the specific embodiment thereof as described and illustrated herein is not to be considered in a limited sense as there may well be other forms or modifications of the invention which should also be construed as coming within the scope of the appended claims.

What is claimed is:

1. A coupling member for effectively transmitting torque to a threaded stud, said coupling member comprising a body portion having one end adapted to be engaged by drive means for supplying torque to rotate said coupling member, the other end being provided with an internal bore which extends inwardly from said other end at least a portion of which is threaded and adapted to receive a threaded stud, said threaded portion having a thread size slightly larger than the thread size of said threaded stud with which it will be used, resilient bar means positioned within said internal bore so as to extend thereacross and spaced from said other end for engaging the end of a threaded stud inserted within the threaded portion of said internal bore and for transmitting torque to a stud being driven, said bar means being bendable along its length so that as torque is applied to drive the stud said resilient bar means bends changing the contact between said resilient bar means and the stud being driven with contact therebetween increasing radially away from the center of said resilient bar means along the periphery of the stud.

2. A coupling member for effectively transmitting torque to a threaded stud, said coupling member comprising a body portion having one end adapted to be engaged by drive means for supplying torque to rotate said coupling member and the other end being provided with an internal bore at least a portion of which extends inwardly from said other end being threaded and adapted to receive said threaded stud, resilient abutment means positioned within said internal bore so as to extend thereacross and spaced from said other end for engaging the end of said threaded stud inserted within the threaded portion of said internal bore and for transmitting torque to said stud wherein said resilient abutment means comprises a rolled pin having a hollow interior.

3. A coupling member as in claim 2 wherein said rolled pin is positioned substantially perpendicularly to the axis of said bore.

4. A coupling member as in claim 2 wherein said rolled pin is removably retained within said coupling member.

5. A coupling member as in claim 2 wherein said rolled pin is positioned within said coupling device such that the portion of said rolled pin having the greatest number of wraps will contact said stud.

6. A coupling member as in claim 2 wherein said rolled pin becomes slightly curved when in driving contact with said stud and thereby differentially contacts the end surface of said stud.

7. A coupling member as in claim 6 wherein said rolled pin contacts the end surface of said stud to a greater degree adjacent the periphery of said end surface than in the central portion thereof.

8. A coupling member as in claim 2 wherein said threaded portion is machined about 0.003 to about 0.005 inches larger than would be necessary to receive the stud to be driven.

9. A coupling member as in claim 2 wherein said one end is provided with a drive socket.

10. An improved stud driving tool for driving threaded studs in which the tool is provided on one end with a wall portion defining threaded bore therein for receiving the threaded stud and means on the other end for connecting a wrench or other tool thereto wherein the improvement comprises providing a rolled pin as a stop member within said threaded bore, said rolled pin extending across said threaded bore substantially at a right angle to the axis thereof and being anchored within the wall portion defining said threaded bore.

11. A method of using an internally threaded stud driving tool having a resilient abutment bar provided therein so as to extend across the threaded portion for driving threaded studs into holes comprising the steps of:

inserting one end of the threaded stud within the drive tool until the drive end surface of the stud engages the resilient bar;

inserting the other end of the stud into the hole;

applying a driving torque to the drive tool sufficient to drive the stud into the hole and simultaneously bending the resilient bar so that it bends along its length thereby changing the degree of contact between the drive end surface of the stud and the resilient abutment with contact being greater at the periphery than at the center of the drive end surface so that oppositely positioned inclined shoulders are formed in the end wall of the stud along which the resilient bar moves;

disengaging the resilient abutment from the drive end surface of the driven stud by applying torque to the drive coupling in a direction opposite to the driving torque thereby allowing the resilient bar to return to its original undeformed condition while simultaneously sliding in an opposite direction along the inclined shoulders so that the drive coupling can be removed from the stud without back rotating the driven stud.

* * * * *